US010066479B2

(12) United States Patent
Maylin et al.

(10) Patent No.: US 10,066,479 B2
(45) Date of Patent: Sep. 4, 2018

(54) DATA COMMUNICATION IN WELLBORES

(71) Applicant: Green Gecko Technology Limited, Aberdeen (GB)

(72) Inventors: Mark Gregory Maylin, Salisbury (GB); Adrian Robert Bowles, Hayling Island (GB); Micheal Alan Jones, Westhill (GB)

(73) Assignee: GREEN GECKO TECHNOLOGY LIMITED (GB)

( * ) Notice: Subject to any disclaimer, the term of this patent is extended or adjusted under 35 U.S.C. 154(b) by 0 days.

(21) Appl. No.: 15/128,966

(22) PCT Filed: Mar. 13, 2015

(86) PCT No.: PCT/GB2015/050734

§ 371 (c)(1),
(2) Date: Sep. 24, 2016

(87) PCT Pub. No.: WO2015/145108

PCT Pub. Date: Oct. 1, 2015

(65) Prior Publication Data

US 2017/0114633 A1 Apr. 27, 2017

(30) Foreign Application Priority Data

Mar. 24, 2014 (GB) ..... 1405215.3

(51) Int. Cl.
*G01V 3/00* (2006.01)
*E21B 47/12* (2012.01)
(Continued)

(52) U.S. Cl.
CPC ..... *E21B 47/122* (2013.01); *E21B 17/003* (2013.01); *E21B 17/16* (2013.01); *E21B 19/16* (2013.01)

(58) Field of Classification Search
CPC ..... E21B 47/122; E21B 17/003; E21B 17/16; E21B 19/16
(Continued)

(56) References Cited

U.S. PATENT DOCUMENTS 5,592,438 A * 1/1997 Rorden ..... E21B 47/101 340/854.3
2005/0046587 A1* 3/2005 Wisler ..... E21B 17/003 340/854.6
(Continued)

FOREIGN PATENT DOCUMENTS

GB 2461064 A 12/2009
GB 2481699 A 1/2012
(Continued)

OTHER PUBLICATIONS

European Patent Office as International Search Authority; ISR and Written Opinion on PCT/GB2015/050734; dated Aug. 24, 2015; entire document.
GB Intellectual Property Office; Search report on GB1405215.3; dated Sep. 22, 2014; entire document.

*Primary Examiner* — Tanmay Shah
(74) *Attorney, Agent, or Firm* — Law Office of Jesse D. Lambert, LLC

(57) ABSTRACT

Method and apparatus to allow continuous recovery and broadcast of data and commands to and from a tubular string (32) through all phases of drilling and completion running in a wellbore. A RF transceiver (76/74) is located on the tubular string, the transceiver being adapted to receive signals and broadcast the signals, and a RF transceiver (88/90) is located remote from the tubular string and adapted to receive the broadcasted signal by virtue of an antenna (92) arranged within a fluid filled annulus (60) around the tubular string.
(Continued)

Figure 1:
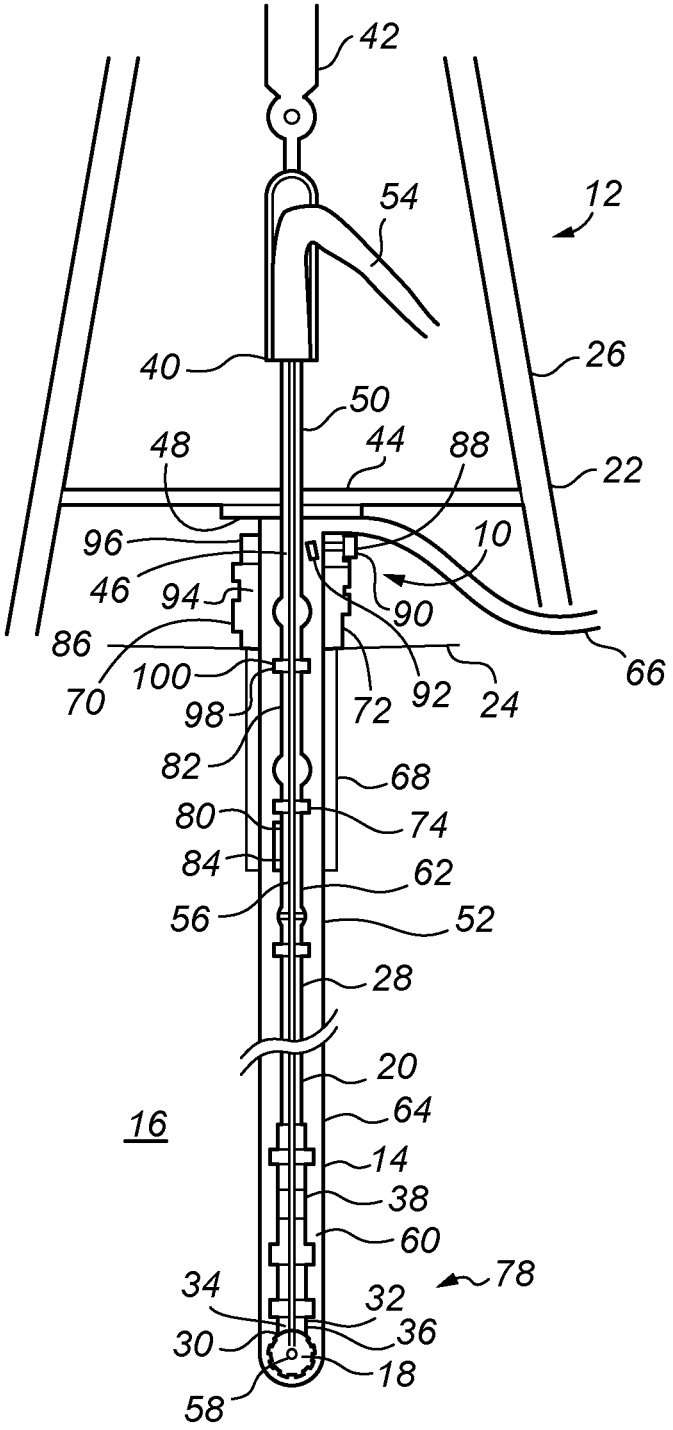

RF transmission through the wellbore using distributed RF transceivers providing data and command transmission up and down the tubing string.

20 Claims, 1 Drawing Sheet

(51) Int. Cl.
*E21B 17/00* (2006.01)
*E21B 17/16* (2006.01)
*E21B 19/16* (2006.01)

(58) Field of Classification Search
USPC ..... 340/854.4
See application file for complete search history.

(56) References Cited

U.S. PATENT DOCUMENTS

| | | | | |
|---|---|---|---|---|
| 2007/0052551 | A1 | 3/2007 | Lovell et al. | |
| 2010/0177596 | A1* | 7/2010 | Fink | E21B 47/14 367/81 |
| 2013/0088362 | A1* | 4/2013 | Yates | G01V 3/00 340/854.3 |

FOREIGN PATENT DOCUMENTS

| | | | |
|---|---|---|---|
| WO | WO 2013/079928 | A2 | 6/2013 |
| WO | WO 2014/004786 | A1 | 1/2014 |

* cited by examiner

DATA COMMUNICATION IN WELLBORES

The present invention relates to data communications to and from a tubing string in oil and gas wellbore operations and in particular, though not exclusively, the invention relates to a method and apparatus to allow continuous recovery and broadcast of data and commands to and from a drill string through all phases of drilling and completion running, inclusive of acquiring data and sending commands whilst running in hole and pulling out of hole.

It is normally desirable to measure various parameters during drilling and subsequent testing of an oil and gas well, for example, pressure, temperature, formation data and wellbore trajectory at or near the bottom hole assembly (BHA) and drill bit and along the wellbore, and to relay these measurements back to the surface where the drilling operation can be controlled. During drilling operations, the weight on bit and rate of rotation of the drill string are two typical parameters that are controlled at the surface in order to affect the rate of penetration of the drill bit through the formation. For example, it is desirable for the drilling engineer controlling the drilling operation at the surface to know when the drill bit is experiencing aggressive local conditions as it cuts into the formation such as high temperatures, pressures or resistance to penetration so that they can adjust, for example, the rate of rotation, the weight on bit and the rate of supply of drilling fluid to the bit in order to avoid driving the bit beyond its normal operation parameters and thereby reducing the risk of bit failure which would require expensive and time consuming intervention. This measurement while drilling (MWD) is well known in the art and various mechanisms have evolved for gathering data at the bit and transmitting these data back to the driller at the surface. Further, the transmission of signals or data which may be referred to measurement while drilling, logging while drilling, seismic while drilling and formation evaluation while drilling, all gather data at the bit or at points along the drill pipe or wellbore and transmit these to the surface. Additionally, the transmission of signals from the surface down the well towards the bit, are used in order to control or operate any downhole tools or devices at any stage in a drilling process.

In a typical drilling operation, a drill bit is located on the end of a series of pipes or tubulars forming the drill string. A drill string is run into the wellbore and rotated in use. In order to assist in the advancement of the drilling and cutting operation, a drilling fluid termed 'mud' is pumped down through the drill string. This mud exits the drill string at or near the drill bit whereupon it is used to carry the drill cuttings from the drill bit back to surface by traveling up the annulus created between the drill string and the wellbore wall or the casing lining the wellbore.

The presence of the mud has been used to provide a signal pathway in the form of a mud pressure pulse system. By modulating the pressure of mud passing through the system, a pressure pulse is created on which data can be modulated and thus passed from downhole to the surface and vice versa. Unfortunately, this system can only achieve transmission of low data rates typically less than 10 bits per second due to the attenuation and distortion of the generated pulses.

Two techniques have been developed which effectively use both the drill pipe and the mud as transmission media. Acoustic signals are formed by the creation of stress waves which can pass along the drill pipe. Unfortunately, as there are multiple boundaries within a wellbore, such as a pipe joint and these acoustic signals suffer multiple reflections creating high interference and signal attenuation. Electromagnetic waves have also been used for signalling. Electromagnetic waves however suffer in that, for use at a frequency sufficient to carry usable data rates, they are attenuated greatly.

One technique which has overcome the difficulties typically experienced in an electromagnetic data transmission system, is that described in WO 2013/079928 by Green Gecko Technology Limited. Such a system provides a series of transceivers located along the drill pipe. The drill pipe is coated with insulators and/or has metal conducting bands arranged upon its surface. The data are transmitted along the drill pipe and through the mud in the wellbore as a RF signal which is relayed between transceiver nodes along the drill pipe. Each transceiver node is located in a housing placed on a collar which may be fixed or rotating with respect to the drill pipe.

This system provides multiple pathways for signal transmission with the system adaptively selecting the path of lowest loss. Indeed, transmission can occur when one or more nodes fail to function. This system can operate at excitation frequencies up to gigahertz enabling data transmission rates from bits per second through to megabits per second or more.

A disadvantage of these transmission systems lies primarily in transmitting the data from a rotating drill string or the inside of a cased well to the topside surface of the well for onward transmission or reception. WO 2013/079928 is silent on this problem while WO 2006/122174 to Baker Hughes Incorporated, has recognized this problem and discloses a system for communicating data between a downhole tool and a surface controller comprising a rotating drill string extending into a borehole and having a downhole telemetry module disposed proximate a bottom end thereof and transmitting a first signal across a telemetry channel. A surface telemetry module is disposed proximate a top end of the rotating drill string and is adapted to receive the first signal transmitted by the downhole telemetry module across the transmission channel. The surface telemetry module has a radio frequency transmitter disposed therein for transmitting a second signal related to the first signal. A stationary communication module has a radio frequency receiver adapted to receive the second signal. As this disclosure provides a system for communicating a signal between the drill pipe and the surface when any downhole transmission system is used, the signal from the selected transmission system is transferred to a RF signal at the top of the drill pipe and then transmitted to a stationary module located at the surface of the well.

Traditionally, a signal can be coupled between a rotating part and a non-rotating part by use of a slip ring-type device as is known in the art. Such a coupling device may be an inductive coupling device. In WO 2006/122174 a first transmitter is located on, and rotates with, the drill pipe. Alternatively, the first transmitter is located at the top drive on a stationary part and the signal from the downhole communication system is coupled to the transmitter via a slip ring device. Thus, the first transmitter is located upon the drill pipe or the top drive but in either case, located at the top-most position of the drill string. The system then provides multiple receivers located around the drilling rig with each of the receivers being coupled to a main controller. Transmission frequencies of 2.4 gigahertz and 5.4 gigahertz are chosen to operate satisfactorily.

However, it is admitted in the document that as the location of the transmitter and receivers is upon the drilling rig, the metallic structure and the movement of metal objects around the rig cause the transmitted signals to be interrupted providing errors such as missing bits or incorrect bits. In order to overcome this discrepancy there are multiple receivers located around the rig with the expectation that at least one receiver will collect a full set of data or at least at the control module, the signals can be compared and whichever receiver has collected the data correctly will be used. Thus, the system is a unidirectional system which mimics an omnidirectional system by use of multiple receivers. The system is reliant on at least one of the receivers receiving the data free from errors or combining the signals collected by more than one receiver to eliminate data errors. There are a number of disadvantages with this arrangement.

In order to operate at 2.4 gigahertz or 5.4 gigahertz, transmission must be effected through air as such signals cannot effectively operate through appreciable distances in the drilling mud, thus, the transceiver must be located on the rig structure and not in the wellbore. The major disadvantage of locating transceivers on the rig structure is that, as described in the document, the metallic structure of the rig interferes with the signal. In order to overcome this, the prior art places multiple receivers around the rig structure. This requires access to the rig structure and the mounting of component parts with cabling to a control module which requires time to install and provides additional components on the rig structure which is already crowded in operation.

Yet further, as the RF signal is unidirectional from the transmitter, there is still a probability that none of the receivers can collect a full signal that is error free.

Still further, as the system has a single RF transceiver at the top of the drill string it is assumed that either a special connection must be made to the particular section of drill pipe which will be at the top drive when drilling commences or a special section of drill pipe, including the transceiver, must be available and used as the final section of drill pipe when signal transmission is required. Where the transceiver is not at the top drive, a special arrangement will be required to ensure that a transceiver is located on a drill pipe section and that drill pipe section must be inserted in the wellbore such that the transceiver is not in the wellbore and is aligned with or at least in range of the receivers on the rig structure. Consequently, it may only be possible to receive signals when the drill pipe is in particular axial positions in the drill string and the drill string is static or being rotated over a limited depth.

Thus a further limitation of this prior art system is that signals cannot be transmitted to or received by the drill pipe when the drill pipe is being reciprocated, made up or taken down.

It is an object of at least one embodiment of the present invention to provide an apparatus to allow continuous recovery and broadcast of data and commands to and from a drill string through all phases of drilling and completion running.

It is a further object of at least one embodiment of the present invention to provide a method to allow continuous recovery and broadcast of data and commands to and from a drill string through all phases of drilling and completion running.

According to a first aspect of the present invention there is provided an apparatus for continuous data transmission from a wellbore, the wellbore having a tubular string extending therein, comprising: at least one RF transceiver located on the tubular string, the transceiver being adapted to receive signals and broadcast the signals; a RF receiver located remote from the tubular string and adapted to receive the broadcasted signal; and wherein the RF receiver includes an antenna arranged within a fluid filled annulus around the tubular string.

In this way, by broadcasting a signal from a transmitter located on the tubular string, the signal can transmit along the tubular string and the fluid in the annulus. A broadcasted signal is omnidirectional within the wellbore and thus the presence of a pick-up antenna located in the annulus therefore guarantees signal reception and removes the requirement of multiple receivers as required in the prior art. Locating the antenna within the annulus also removes the requirement to have a receiver located on the drilling rig.

Preferably, the RF receiver is part of a second RF transceiver to provide continuous data transmission to the wellbore. In this way, the apparatus provides for continuous recovery and broadcasting of data and commands to and from the tubular string.

Preferably the RF receiver is mounted on a tubular portion bounding the annulus. The tubular portion may be casing, liner, riser, conductor or a pipe spool section. In this way, the receiver can be pre-installed in the rig pipe work ahead of drilling or left in situ during the drilling operations. Alternatively, the receiver and antenna can be inserted and removed as required at any stage in the well operation using pressure control systems commonly used in wellheads for live access.

Preferably, the apparatus includes at least one downhole signal transceiver adapted to receive data from a signal generator. In this way, the transmitted data can come from sensors known in the art to measure pressure, temperature, drill string torque, drill bit speed and load. Alternatively, signal generators may represent sensors located along the tubular string or in a bottom hole assembly measuring formation properties. In this way, data from downhole signal generators are continuously broadcast to the surface of the wellbore.

Preferably, there is a plurality of RF transceivers, the transceivers being linked as nodes along the tubular string. In this way, the signals can be transmitted across connections in the tubular string so that no data loss occurs over joints created in the tubular string. Additionally, a plurality of nodes provides for redundancy if one node should fail so that the data is always successfully transmitted down the wellbore.

Preferably, the transceivers are arranged on collars located around the tubular string, the collars being free to rotate relative to the tubular string. In this way, the RF transceivers can be easily mounted upon existing tubular strings. Thus, sections of drill pipe, completion tubing, or any other downhole tubing or piping can be used with the transceivers located thereupon. By placing the transceivers on collars which are free to rotate relative to the tubular string, the collars can be used as friction reducers or spacers and prevent sticking within the wellbore if the tubular string is rotated.

Advantageously, at least a portion of the surface of the tubular string is coated with an electrically active coating. By providing an electrically active coating on the surface of the tubular string, the transmission distances and data rates can be increased as this provides a preferred signal path for the RF transmission.

Advantageously, the electrically active coating may include wear resistant and/or friction reducing properties. In this way, the coating assists in the rotation of the tubular string during well operations. The coating may be applied to joints on the tubular string to act as substitutes for weld-bands. Providing electrically active weld-bands substitutes gives the dual-purposes of pipe protection and enhanced data communication, with the advantage that the bands can be made thinner than existing weld bands by spraying on the coating.

According to a second aspect of the present invention there is provided a method of continuous data transmission from a wellbore, the wellbore having a tubular string extending therein comprising the steps:

a) locating at least one RF transceiver on the tubular string;
b) locating a RF receiver remote from the tubular string;
c) locating an antenna of the RF receiver in a fluid filled annulus around the tubular string;
d) receiving at least one signal at the, at least, one RF transceiver and broadcasting the at least one signal; and
e) picking up the, at least, one broadcasted signal at the antenna.

In this way, a continuous recovery of broadcasted data from the tubular string is obtained.

Preferably, the method includes the further steps of locating a RF transmitter with the RF receiver; broadcasting at least one signal from the antenna and receiving the at least one signal at, at least one RF transceiver in the tubular string. In this way, commands can be transmitted from the surface through the wellbore to bottom-hole assemblies and devices such as drill bits.

Preferably, the method includes the step of collecting data from downhole signal generators and transmitting data signals to the RF receiver. In this way, data from sensors and measurement devices within the wellbore can be transmitted to the surface continuously.

Preferably, the method includes the step of transmitting commands to a downhole assembly via the RF transmitter and the at least one RF transceiver. In this way, commands to operate downhole assemblies such as drill bits, downhole actuators and other downhole devices can be achieved continuously during well operations.

At least one embodiment of the present invention allows continuous recovery and broadcast of data and commands to and from the tubular string through all phases of drilling and completion running. The method may include steps of performing any drill floor operations such as rotating of the string or pipe, drilling, circulating, reverse circulating, pressurizing the tubular string ID or annulus, reciprocating, making up and breaking tool connections, and static.

In this way, the method of the present invention is not limited to data transmission during the drilling conditions as in any of the prior art data telemetry systems.

Optional features described in relation to one embodiment can typically be combined alone or together with other features in different embodiments of the invention. Various embodiments and aspects of the invention will now be described in detail with reference to the accompanying Figure. Still other aspects, features and advantages of the present invention are readily apparent from the entire description thereof including the Figure which illustrates an exemplary embodiment and aspect and implementations. The invention is also capable of other and different embodiments and aspects and its several details can be modified in various aspects all without departing from the spirit and scope of the present invention.

Accordingly, the drawings and description are to be regarded as illustrative in nature and not as restrictive. Furthermore, the terminology and phraseology used herein is solely used for descriptive purposes and should not be construed as limiting in scope languages such as including, comprising, having, containing or involving and variations thereof is intended to be broad and encompass the subject matter listed thereafter, equivalents and additional subject matter not recited and is not intended to exclude other additives, components, integers or steps. Likewise, the term comprising, is considered synonymous with the terms including or containing for applicable legal purposes. Any discussion of documents, acts, materials, devices, articles and the like is included in the specification solely for the purpose of providing a context for the present invention. It is not suggested or represented that any or all of these matters form part of the prior art based on a common general knowledge in the field relevant to the present invention. All numerical values in the disclosure are understood as being modified by "about". All singular forms of elements or any other components described herein are understood to include plural forms thereof and vice versa.

While the specification will refer to up and down along with uppermost and lowermost, these are to be understood as relative terms in relation to a wellbore and that the inclination of the wellbore, although shown vertically in the Figure, may be inclined. This is known in the art of horizontal wells.

FIG. 1 is a schematic illustration of a drilling system in a wellbore including apparatus for continuous data transmission from the wellbore according to an embodiment of the present invention.

Embodiments of the present invention will now be described, by way of example only, with reference to the accompanying Figure showing a schematic illustration of a drilling system in a wellbore.

Referring to FIG. 1, there is illustrated a data communication system generally indicated by reference numeral 10 located in a drilling system, generally indicated by reference numeral 12. The drilling system 12 is as known in the art, and the communication system 10 is according to an embodiment of the present invention.

The drilling system 12 is used to provide a wellbore 14 through which hydrocarbon fluids from a formation 16 are collected for use. In order to access the hydrocarbon fluids in formation 16, a drilling system 12 is used. Primarily, a drill bit 18 is run into a wellbore 14 to create the depth of the wellbore 14 and access the levels of the formation 16. The drill bit 18 is operated by rotating the drill bit and the tubing on the drill pipe 20 to which it is attached.

In order to create the drill pipe 20 a rig, generally indicated by reference numeral 22, is provided on the surface 24 positioned at a location where the wellbore 14 is desired to be drilled. A drilling rig 22 comprises a derrick 26 which is a structure used to support a tubular string 32 of drill pipe 20 as it travels through the wellbore 14. Drill pipe 20 is made up from tubular sections of pipe 28 which are joined to each other by known pin and box sections. Such pin and box sections are male and female screw threads provided at the top and bottom end respectively of the pipe sections 28.

At the distal end 30 of the string 32, is located the drill bit 18. Behind the drill bit 18 there is located the drive mechanism 34 for the drill bit which may include sensors 36 for monitoring conditions around the drill bit such as pressure, temperature, weight on the drill bit, and speed of rotation. It will be apparent to those skilled in the art that other sensors and logging tools can be located on the string 32 also. A mud motor 38 may also be located in the string in order to assist in rotation of the drill bit 18 in use.

The string 32 is supported at the surface by a swivel or top drive 40. The top drive allows rotation of the drill pipe 20 while supporting the weight of the string 32 via a traveling block or crown block arrangement 42 suspended from the derrick 26. As the string is rotated into the wellbore and the drill bit 18 removes material from the formation 16, the depth of the wellbore increases and additional tubular sections 28 require to be added to the drill string 32 in order to access the deeper regions of the wellbore 14. Such tubular sections are added at the drill floor 44 where the individual tubular sections 28 are made up by locating a lower section 46 on a rotary table 48 and an upper section 50 being located between the lower section 46 and the top drive 40. The upper section 50 is connected to the top drive 40 and with the assistance of the fixed rotary table 48, the upper section 50 is rotated into a screw thread fitting mating the box and pin sections on the respective parts. Once the connection is made up, the entire string 32 is rotated via the top drive 40 and the drill bit 18, operated under the weight of the string to drill the formation 16.

To assist in the drilling of the formation 16, a fluid is supplied. The fluid in drilling operations is referred to as mud 52. Mud is supplied via a mud hose 54 which connects to the top drive 40 and delivers the mud into a through-bore 56 of the string 32. The mud 52 is pumped at pressure down the bore 56 and exits through apertures 58 in the drill bit 18. The mud is circulated through the wellbore and, as such, when exiting the apertures 58, is forced up the wellbore in the annulus 60 created between an outer surface 62 of the string 32 and the inner wall 64 of the wellbore 14. When the returned mud reaches the surface 24, it is directed out of the annulus 60 by a return mud line 66. The mud is typically cleaned to remove drill cuttings which have been lifted from the formation and the mud returns for use in the wellbore via the mud hose 54. Those parts describing the cleaning of the mud will be as known in the art and are not described in the present application.

As the wellbore 14 is drilled, in order to prevent the walls 64 collapsing, casing 68 can be located in the wellbore 14 and cemented in place. Further lengths of casing can be inserted through the existing casing in sections to support deeper lengths of wells. Alternatively or additionally, liner can also be incorporated in the well. The liner is hung from the lower end of an existing section of casing or liner. This is in contrast to casing which in general is referred to as sections of tubulars which return to the surface 24 of the wellbore 14. For illustrative purposes only, FIG. 1 shows a single casing section 68 in place.

At the surface 24, there will be located a wellhead 70 with a structure including valves (not shown) to control the entry and exit of hydrocarbon fluid once the well is producing. In the wellhead 70 there will also be blow-out preventers 72 used to seal the well in an emergency. These may be of annular type or pipe ram, or blind ram type. However, the string 32 is free to pass through the wellhead 70 during normal operations. The return mud line 66 is one such tubing which is connected to the wellhead 70 via a valve. This therefore forms the description of a prior art drilling system 12.

In the present invention there is incorporated a communication system 10 for the continuous recovery and broadcast of data and commands to and from the drill string 32. It is designed to operate in all phases of drilling and indeed, the further completion of the well. Within the wellbore 14, data transmission up and down the string 32 is as described in WO 2013/079928, which is incorporated herein by reference. Spaced apart along the string 32 are collars 74 which may be clamped to the string 32 and thus are held to, and rotate with, the string 32 or they may be free-running and thus rotate relative to the string 32. In the arrangement where the collars rotate relative to the string, stop bands may be incorporated upon the string to limit their longitudinal movement up and down the string 32. There may be a collar 74 located upon each tubular section 28 or stand. This would provide a spacing of around 30 feet between the collars. Alternatively, they may be spaced further apart or closer together.

Each collar 74 incorporates a transceiver 76. Each transceiver is designed to collect RF signals, process the signals to incorporate a unique identifier on the signal to determine that the signal has been collected and transmitted through the individual transceiver 76 and is transmitted into the wellbore 14. If a transceiver is at fault, the signal will not be picked up by that transceiver and a further transceiver, typically the next in the line, will receive the signal and place its own identifier thereon. In this way, when the signal reaches the surface, a fault detection system can determine the need to repair or replace the faulty transceiver 76 and collar 74 when that drill pipe is removed from the wellbore 14.

In this embodiment, it is RF signals that are transferred between the transceivers and in this way, the signals representing data collected from within the wellbore can be relayed to the surface and equally, commands can be sent from the surface to the drive mechanism 34, sensors 36 and drill bit 18 in what would commonly be referred to as a bottom hole assembly 78. Each transceiver wirelessly picks up the RF signal and the signal is transmitted in any route available, this can be through excitations on the drill pipe 20, the mud 52 or indeed, the formation 16. Thus an adaptive transmission system is formed with the signal automatically taking the path, selected from multiple paths available, of lowest loss through the wellbore. It will be appreciated by those skilled in the art, that the respective transmission properties of each of the drill pipe 20, the mud 52 and the formation 16 will greatly influence the distance through which the signals can be transmitted.

In order to assist the transmission of the signals, the drill pipe 20 may be provided with a coating 80. Coating 80 is applied to the outer surface 62 of the string 32. Coating 80 may form an insulating coating layer which may have wear properties and/or friction reducing properties to assist in the strings 32 passage through the wellbore 14. Coating 80 may be applied by typical flame-spray coating techniques, for example, by HVOF coating (high velocity oxy-fuel coating) or plasma spraying directly onto the outer surface 62 of the pipe 20. This coating 80 may also be made electrically active. It is known for example that the deposited material from such spraying techniques forms a state when deposited which yields electrical and mechanical properties which are different from the normal bulk material properties. For materials such as copper and other metals and for non-metallics such as polymers or ceramics this creates electrical properties that can be altered by various degrees of compositional and topological changes in the sprayed materials and by the processes such as thermal annealing post-deposition.

In further embodiments, a signal conductor 82 may also be applied over the outer surface 62 of the string 32. The signal conductor 82 may typically be in the form of metal strips, metallic sheet or mesh. Typically, an inner coating 80 applied to the outer surface of the string 62 electrically insulates and physically isolates the outer surface of the string 62 from the signal conductor 82 so that none of the component parts of the signal conductor 82 come into physical contact with the outer surface of the string 62 at any point. There may then be a further outermost layer 84 which is typically formed of a hard-wearing material that primarily insulates and isolates the signal conductor 82 from the external environment around the tubular string 32 i.e. the fluid 52 which exists in the annulus 60. This multi-layer arrangement of coating 80, signal conductor 82 and outermost layer 84 provides a preferential path for the RF signal to move up or down the string 32 between the transceivers. Equally, the signal may pass through the mud 52.

Further, electrical pathways may be created by providing wear bands at the tool joints 86. It is known that drill pipe tool joints may be treated with a weld band which forms a 360° additional protrusion on the diameter of the pipe. The weld band is typically around ¼ inch in thickness. The primary purpose is to reduce mutual wear between the tool joint and the adjacent casing 68. In the present invention, these wear bands are created by electrically active coatings deposited by spraying on the drill pipe outer surface 62. These coatings are of benefit to the data rates and transmission distances which can occur up and down the drill pipe 20. Additionally, these coatings can be selected to have beneficial friction-reducing and wear-reducing properties. These coatings would be applied typically in thicknesses between 0.1 mm and several millimeters typically by thermal spray and plasma spray processes. It is known in the art that such coatings will adhere to pipe under the most extreme of conditions. Suitable coating materials may be selected from aluminia, yttria-stabilized-zirconia, alumina-titania and all of their closely related compositions. Some of these non-metallic options could include special wear-reducing agents such as PTFE. Additionally, some compositions comprising of more metallic choices such as steels and lightweight alloys could be used to give beneficial electrical and wear properties.

We have described a method and apparatus of transmitting RF signals up and down a wellbore by using nodes including transceivers 76 located on collars 74 along the length of the string 32. There is however, a requirement to have the signal pass between the string 32 and a receiver 88 located on the surface 24 of the wellbore 14 for connection to a master controller. Preferably signals should also pass from the surface 24 to the string 32 for onward transmission and/or reception of commands to be passed via a transmitter 90 also located at the surface back to the string 32 to pass the commands down the string to the bottom-hole assembly 78.

In order to achieve this, the present invention locates an antenna 92 at an upper end 94 of the wellbore 14. It is noted that in the diagram provided, the wellbore extends through the wellhead 70. The antenna may equally be placed in a position below the wellhead 70 if desired. The antenna 92 is located between the outer surface of the string 62 and the inner wall 64 of the wellbore 14. It will be appreciated that the antenna may be located in a recess on the inner surface of the wellbore or in a side port wherein the antenna sits outside the inner surface of the wellbore. Where the antenna 92 is in a side port, this is still considered to be in the annulus 60 as the antenna 60 still accesses the fluid 52 located in the annulus 60. Thus, for a drilling system, the antenna 92 can lie below the position of the return mud line 66. While a wellhead 70 is shown, this could equally be a riser, conductor or similar tubular construct. In the embodiment shown, the antenna 92 is placed in the return fluid pipe via a pre-installed piping spool piece 96 located on the wellhead. The antenna could equally be placed on an existing access valve or hot tap band. The antenna is connected to the external surface 24 either via a cable that exits the system usually via a fluid pressure-type penetration or wirelessly as is known in the art.

In use, the antenna with its associated receiver 88 and transmitter 90 can be pre-installed in the rig 22 pipe work ahead of drilling and left in situ until the drilling operations are complete and the rig moves off location or the antenna 92 can be inserted and removed as required at any stage in the well operation using pressure control systems commonly used in wellheads for live access.

The drill pipe sections 28 can be pre-treated with the coating 80 and/or signal conductor 82 and/or outermost layer 84. Optionally, the wear bands 86 may be sprayed on the tool joint positions. The collars 74 containing a receiver 76 in a specially adapted housing can be clamped to the outer surface 62 of each section 28 as desired. As suggested previously, the collars 74 may be fastened to the string sections 28 or may be left free to rotate being bound between stops (not shown).

A drilling operation is then performed in standard fashion. Sections of a drill pipe 20 are assembled on the rig floor 44 using the pin and box sections as is known in the art. As the string 20 is made up, signals can be passed between the transceivers 76 on the collars 74 and the antenna 92. Specifically, the transceivers on the collars 74 broadcast signals collected at the bottom-hole assembly 78. These signals can pass through the mud and thus regardless of the orientation of the drill pipe 20, with respect to the antenna 92, the signals will be recovered.

Additionally, there is no requirement for the transceiver 76 to be located at the same depth in the wellbore 14 as the antenna 92 for signal transmission to occur. In this way, they do not require to be aligned at the same vertical position in the wellbore for operation. Thus, the signals can be transmitted continuously during well operations occurring such as rotating of the string or pipe, drilling, circulating, reverse circulating, pressurizing (the through-bore 56 or the annulus 60), reciprocating, making up and breaking tool connections and when the system is static. Equally commands can be transmitted via the transmitter 90 and antenna 92 to be picked up by the transceiver 76 continuously also.

It is noted that uppermost transceiver 98 on the uppermost collar 100 need not be the transceiver which picks up the signal broadcast from the antenna 92, nor be the one to transmit the signal to the antenna 92. The use of RF signals provides the opportunity for the lower arranged transceiver to achieve this with the location of the fluid in the annulus determining where the transceivers can be located. Typical excitation frequencies are up to gigahertz enabling data transmission rates from bits per second through to megabits per second. In an embodiment, the arrangement of the drill pipe 20, coating 80, signal conductor 82 and layer 84 together with the fluid 52 and even the formation 16, all provide signal pathways for the broadcasted signal to reach a node and thus, a transceiver 76 further down the drill pipe 20 can achieve transmission/reception with the antenna 92. This is a fail-safe measure giving redundancy for contingency in the event that the uppermost transceiver 98 fails in some way.

Advantageously, as the commands are passed down the drill pipe 20 or the data signals received up the drill pipe 20, each transceiver 76 encodes the data signal with a unique identifier to verify that the signal has been passed through the transceiver. The data signal may be amplified by a transceiver as the transceiver may include amplification means together with power means such as a battery located in the housing of the collar 74.

Additional signals can be generated at the bottom-hole assembly from the drive mechanism 34, sensors 36 and mud motor 38. Further signals from sensors located along the drill string 20 can also be collected at each of the transceivers and passed up the wellbore being broadcast for reception at the antenna 92 and passed to the surface for processing and analysis.

Accessing the wellbore in this manner places the antenna 92 at a location that allows reception of, and transmission of, RF signals (both data and commands) to and from the pipe 20 without interfering with or infringing upon any operations at the drill floor continuously through any phase of well operations.

The principle advantage of the present invention is that it provides an apparatus and a method to allow continuous recovery of data to and from a drill string or other tubular string through all phases of drilling, completion running and other well operations in a wellbore.

A further advantage of at least one embodiment of the present invention is that it provides an apparatus and a method to allow continuous recovery and broadcast of data and commands to and from a drill string or other tubular string through all phases of drilling, completion running and other well operations in a wellbore.

A further advantage of the present invention is that it provides a data communication system which can be pre-installed on the rig pipe work ahead of drilling and left in situ until the drilling operations are complete and the rig moves off location.

Yet further, an advantage of the present invention is that it provides a data communication system which can be inserted and removed at any stage in the well operation so that such a data communication system can be installed into existing well constructions when intervention is required.

A still further advantage of the present invention is that it provides a data communication system in which signals can be passed between a drill pipe and a surface of a wellbore without requiring parts located on the top drive of an existing drilling system or an arrangement of receivers to be located across a drilling system.

Modifications may be made to the invention herein described without departing from the scope thereof. For example, while the embodiment of FIG. 1 shows a drilling system, the present invention has equal application in completing a wellbore where the tubular string may be the production tubing or other tubing inserted in the wellbore. In this regard, the fluid in the annulus may be a liquid, a gas, a liquid carrying solids, a gas carrying solids, a gel, a foam or be of multiphase fluid. The fluid may also be of a multiple of components such as oil, mud and brine.

The invention claimed is:

1. Apparatus for continuous data transmission from a wellbore through all phases of drilling and completion, the wellbore having a tubular string extending therein, comprising:

at least one RF transceiver located on the tubular string, the transceiver being adapted to receive signals and broadcast the signals;

a RF receiver located remote from the tubular string and adapted to receive the broadcasted signal;

wherein the RF receiver includes an antenna arranged at an upper end of the wellbore within a fluid filled annulus between an outer surface of the tubular string and an inner wall of a tubular construct in the wellbore.

2. Apparatus according to claim 1 wherein the RF receiver is part of a second RF transceiver to provide continuous data transmission to the wellbore.

3. Apparatus according to claim 1 wherein the tubular construct is selected from a group comprising: casing, liner, riser, conductor and pipe spool.

4. Apparatus according to claim 1 wherein the apparatus includes at least one downhole signal transceiver adapted to receive data from a signal generator.

5. Apparatus according to claim 1 wherein there are a plurality of RF transceivers, the transceivers being linked as nodes along the tubular string.

6. Apparatus according to claim 1 wherein the RF transceivers are arranged on collars located around the tubular string, the collars being free to rotate relative to the tubular string.

7. Apparatus according to claim 1 wherein at least a portion of a surface of the tubular string is coated with an electrically active coating.

8. Apparatus according to claim 7 wherein the electrically active coating has wear resistant properties.

9. Apparatus according to claim 8 wherein the coating is applied to joints of the tubular string to act as weld-bands.

10. Apparatus according to claim 7 wherein the electrically active coating has friction reducing properties.

11. A method of continuous data transmission from a wellbore through all phases of drilling and completion, the wellbore having a tubular string extending therein, comprising the steps:

(a) locating at least one RF transceiver on the tubular string;

(b) locating a RF receiver remote from the tubular string;

(c) locating an antenna of the RF receiver in a fluid filled annulus between an outer surface of the tubular string and an inner wall of a tubular construct in the wellbore;

(d) receiving at least one signal at the at least one RF transceiver and broadcasting the at least one signal;

(e) picking-up the at least one broadcasted signal at the antenna.

12. A method according to claim 11 including the steps of:

(f) locating a RF transmitter with the RF receiver;

(g) broadcasting at least one signal from the antenna; and (h) receiving the at least one signal at least one RF transceiver on the tubular string.

13. A method according to claim 12 including the step of transmitting commands to a downhole assembly via the RF transmitter and the at least one RF transceiver.

14. A method according to claim 11 including the step of collecting data from downhole signal generators and transmitting data signals to the RF receiver.

15. A method according to claim 11 wherein the method includes the step of rotating the tubular string when the signal is broadcast.

16. A method according to claim 11 wherein the method includes the step of circulating fluid through the annulus when the signal is broadcast.

17. A method according to claim 11 wherein the method includes the step of pressurising the annulus when the signal is broadcast.

18. A method according to claim 11 wherein the method includes the step of pressurising a bore of the tubular string when the signal is broadcast.

19. A method according to claim 11 wherein the method includes the step of reciprocating the tubular string when the signal is broadcast.

20. A method according to claim 11 wherein the method includes the step of making and breaking tool connections on the tubular string when the signal is broadcast.

* * * * *